US008286274B1

(12) United States Patent
Manning

(10) Patent No.: US 8,286,274 B1
(45) Date of Patent: Oct. 16, 2012

(54) RESTROOM AID

(76) Inventor: John Manning, Cathedral City, CA (US)

( * ) Notice: Subject to any disclaimer, the term of this patent is extended or adjusted under 35 U.S.C. 154(b) by 0 days.

(21) Appl. No.: 13/211,314

(22) Filed: Aug. 17, 2011

Related U.S. Application Data

(60) Provisional application No. 61/470,387, filed on Mar. 31, 2011.

(51) Int. Cl.
*E03D 11/00* (2006.01)

(52) U.S. Cl. ..... 4/254

(58) Field of Classification Search ..... 4/254, 902; 414/921
See application file for complete search history.

(56) References Cited

U.S. PATENT DOCUMENTS 2,792,052 A * 5/1957 Johannesen ..... 297/5
3,739,793 A * 6/1973 Wilson ..... 5/503.1
4,587,678 A * 5/1986 Love et al. ..... 4/667
4,613,994 A * 9/1986 Oates ..... 4/480
5,123,126 A * 6/1992 Vincent ..... 4/480
5,465,744 A * 11/1995 Browning ..... 135/67
5,509,152 A * 4/1996 Kippes ..... 5/81.1 R
7,775,228 B2 * 8/2010 Clark ..... 135/66

* cited by examiner

*Primary Examiner* — Lori Baker

(74) *Attorney, Agent, or Firm* — Kafantaris Law Offices; Theo Kafantaris

(57) ABSTRACT

A restroom aid is disclosed for providing comfortable support for disabled, handicapped, elderly, or ill persons who require assistance using the restroom facilities. The restroom aid creates a sturdy frame around the toilet with aids for sitting, standing, and supporting the user's arms and head. The restroom aid can assemble and disassemble quickly using a quick-release mechanism. Furthermore, the restroom aid is easily adjustable to fit users and restroom facilities of different sizes.

10 Claims, 8 Drawing Sheets

RESTROOM AID

CROSS-REFERENCE TO RELATED APPLICATIONS

This application claims the benefit of U.S. Provisional Patent Application No. 61/470,387, filed on Mar. 31, 2011, and incorporated herein by reference.

STATEMENT REGARDING FEDERALLY SPONSORED RESEARCH AND DEVELOPMENT

Not Applicable.

FIELD OF THE INVENTION

This invention relates to a restroom aid, and more particularly, to an apparatus to aid in sitting, standing, and resting while using the facilities of a restroom.

DISCUSSION OF RELATED ART

A restroom is generally a private area where individuals can relieve themselves and attend to their own personal hygiene. A typical restroom comprises at least a faucet, sink and toilet, and oftentimes includes a mirror and table surface as well. Private restrooms, or residential restrooms, typically comprise a completely private room where all of the facilities are intended to be used by one individual at a time. Public restrooms are separated by sex and are intended to be used by more than one individual. Public restrooms generally comprise a private area, or stall, where the toilet is located, and a shared area where the faucet and sink are located.

When using restroom facilities, common activities include sitting, standing, and resting on the facilities. Due to the private nature of a restroom or stall, these activities are intended to be performed alone. However, many individuals have difficulty performing these simple tasks. To compensate for these individuals, public restrooms offer handicap accessible stalls which help when sitting and standing. Private restrooms can also be fitted with various aids as well.

While restrooms can be fitted with aids that provide assistance to the facilities, the aids are not robust enough to satisfy those with more serious conditions, especially when head and neck support are necessary. Therefore, a need exists for a restroom aid that is robust enough to accommodate individuals who have serious difficulty sitting, standing, or resting on conventional restroom facilities. The present invention accomplishes these objectives.

SUMMARY OF THE INVENTION

The present device will provide strong, comfortable support for disabled, handicapped, elderly, or ill persons who might otherwise require assistance getting to and from the toilet. Furthermore, the present invention will provide a means of resting and supporting the user's arms and head while on the toilet. This is accomplished by creating a sturdy frame around the toilet with several aids for sitting, standing, and resting.

The frame comprises a base, two vertical posts, a support brace, a toilet brace, a crossbar and two auxiliary braces. The base is used to create a stable structure on the floor. The toilet and auxiliary braces add support by anchoring the invention to the toilet. The support brace and crossbar attach to the vertical posts, and further aid in the rigidity of the invention. As a result, a rigid structure is provided that can accommodate any individual of any size. All of these features are fully adjustable for toilets, bathrooms and individuals of varying size.

Two armrests are positioned on each vertical post. The armrests double as a comfortable support when using the toilet and as an aid to raise and lower the individual onto the toilet. A headrest is positioned at the center of the crossbar, allowing the user to rest their head and neck when using the toilet. The armrest and headrest are also fully adjustable. Furthermore, the entire assembly is quickly and easily assembled and disassembled using a quick-release mechanism.

These and other objectives of the present invention will become obvious to those of ordinary skill in the art after reading the following detailed description of the preferred embodiments. It is to be understood that the foregoing general description and the following detailed description are exemplary, and are intended to provide further explanation of the invention as claimed.

DETAILED DESCRIPTION OF THE PREFERRED EMBODIMENT

Figure 1:
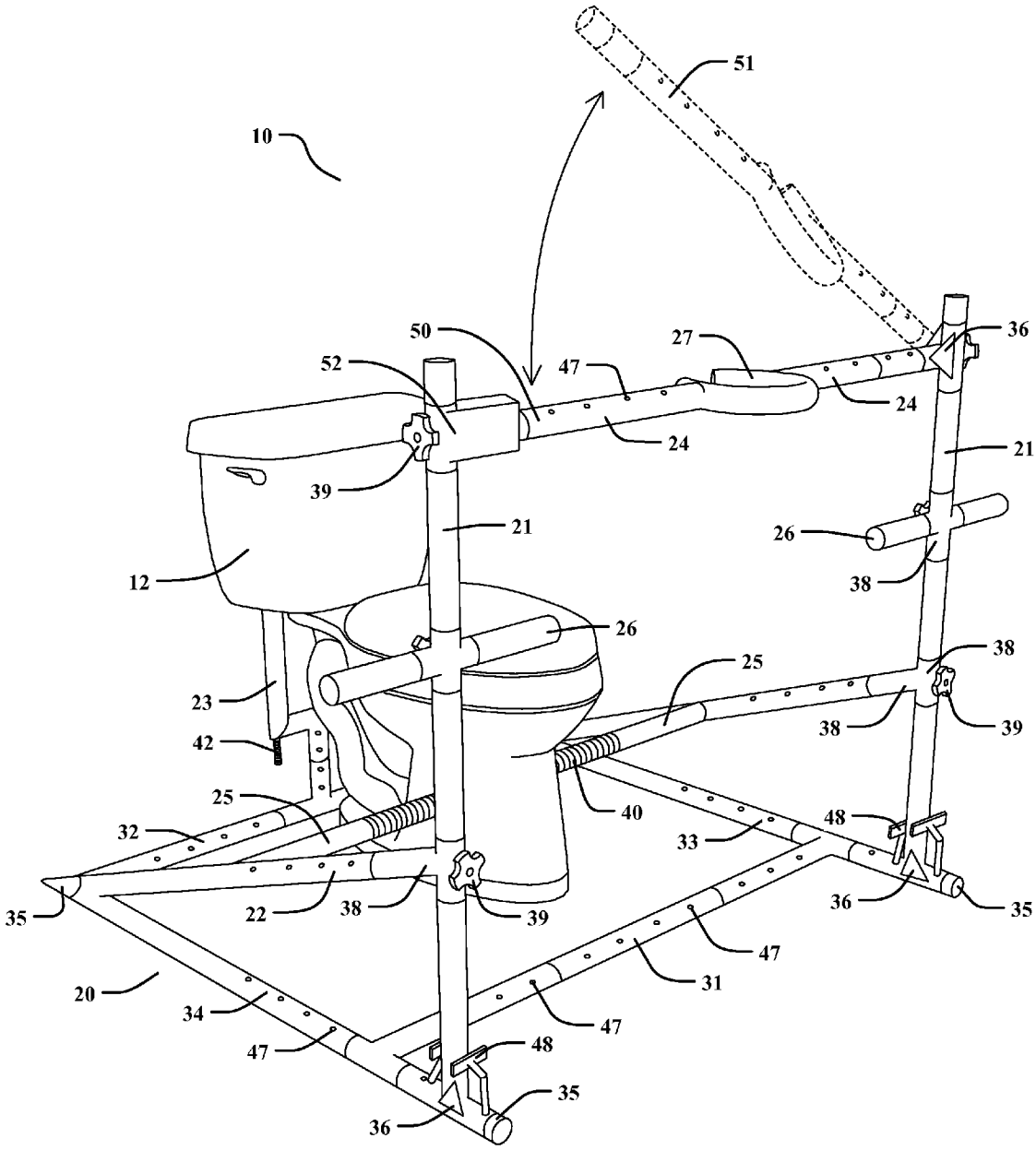
FIG. 1 is a front isometric view of the invention.
Figure 2:
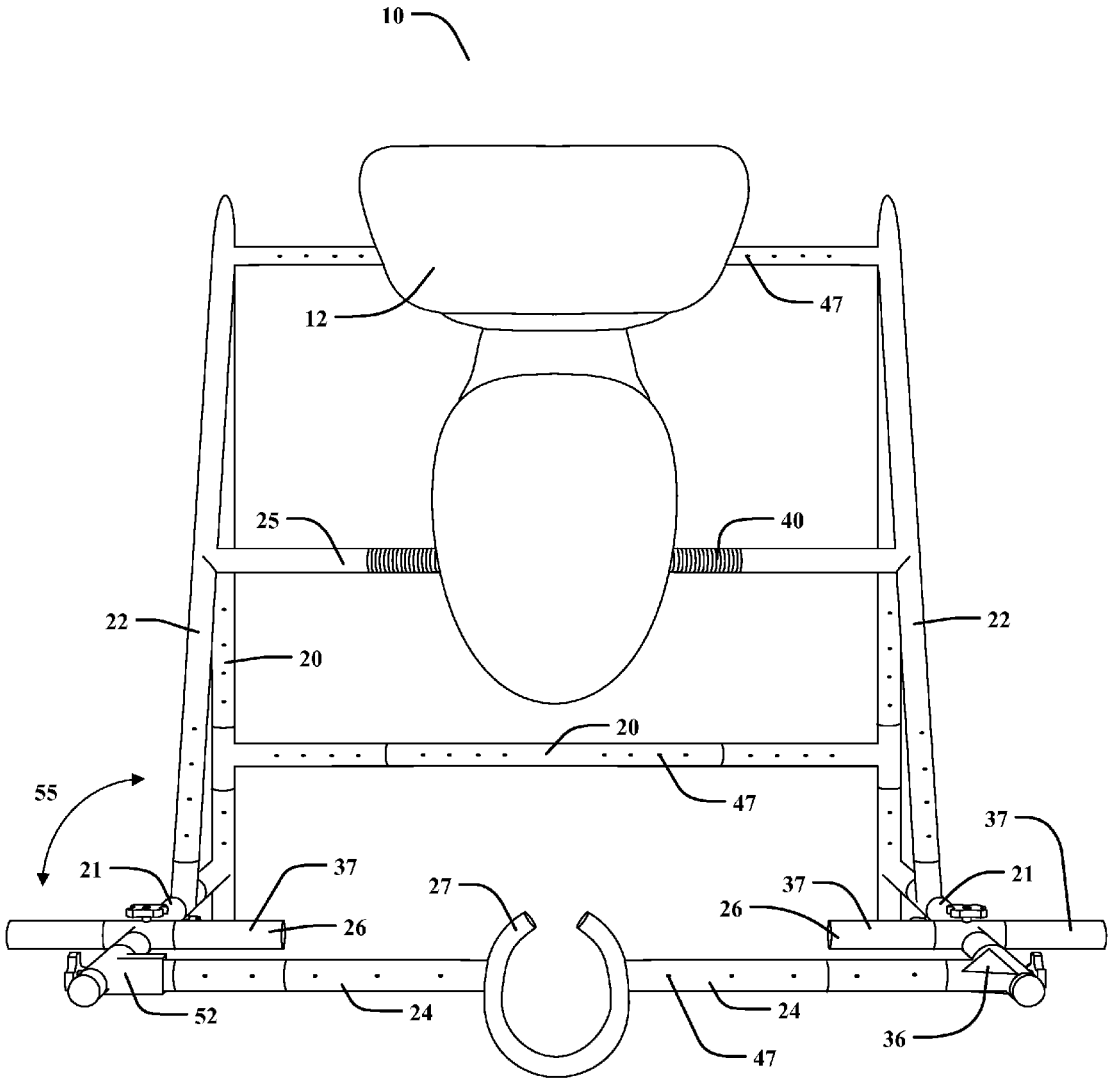
FIG. 2 is a top perspective view of the invention.
Figure 3:
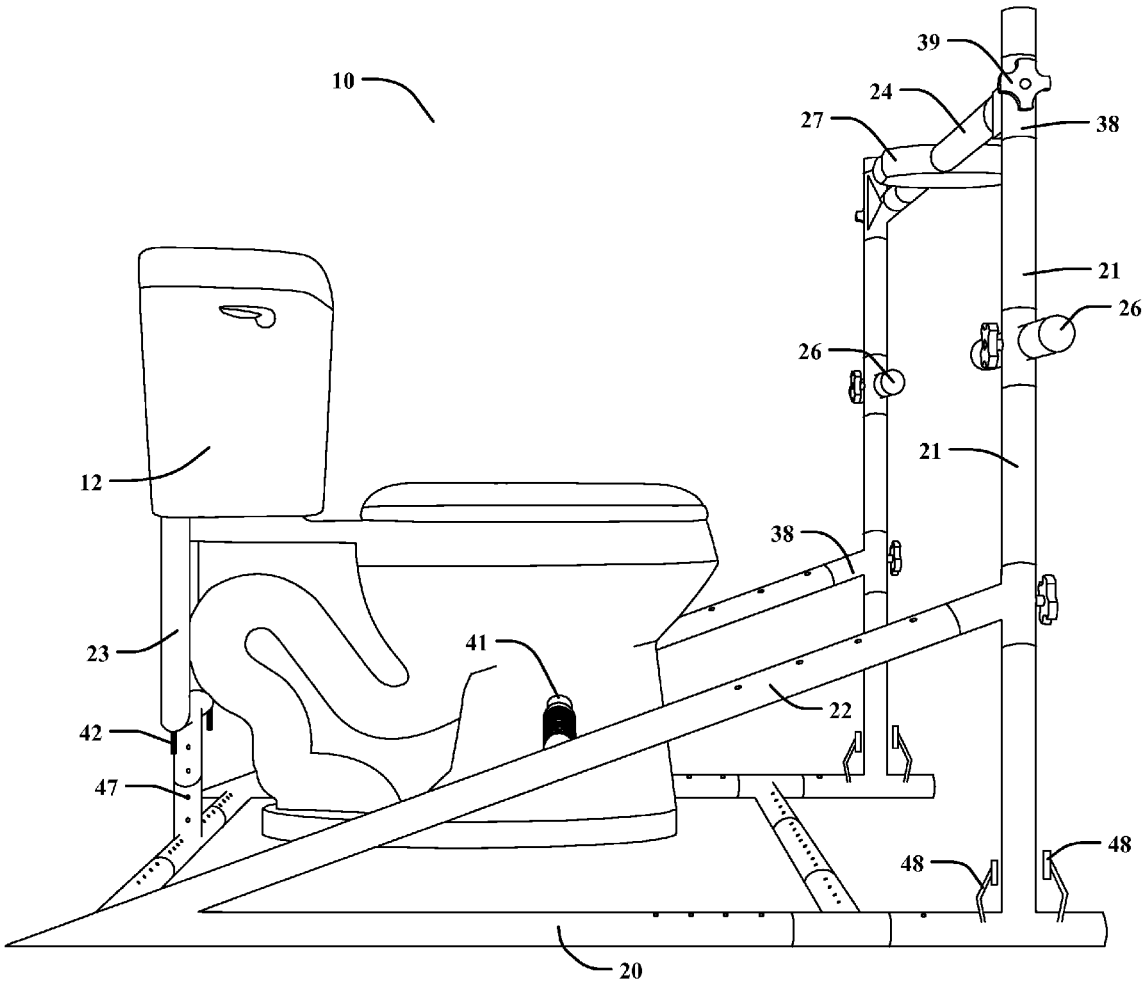
FIG. 3 is a side perspective view of the invention.
Figure 4:
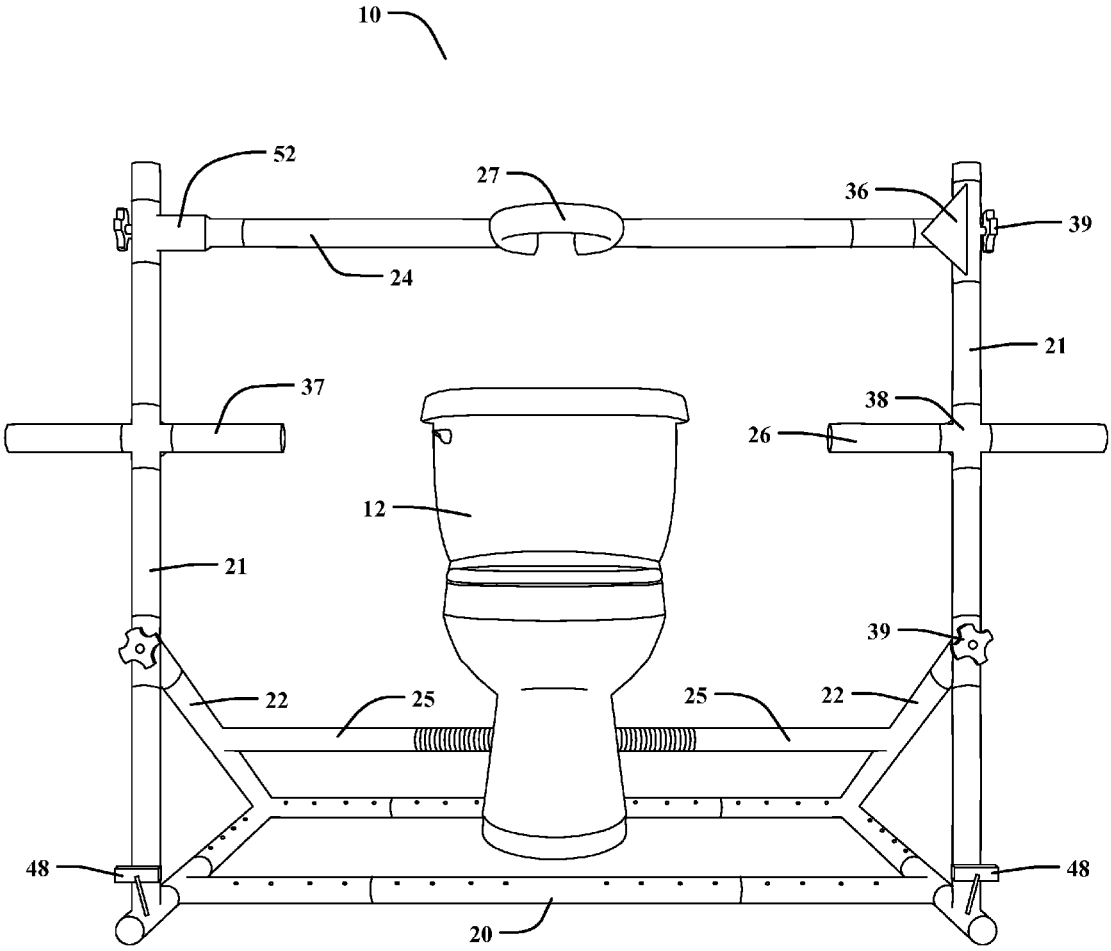
FIG. 4 is a front perspective view of the invention.
Figure 5:
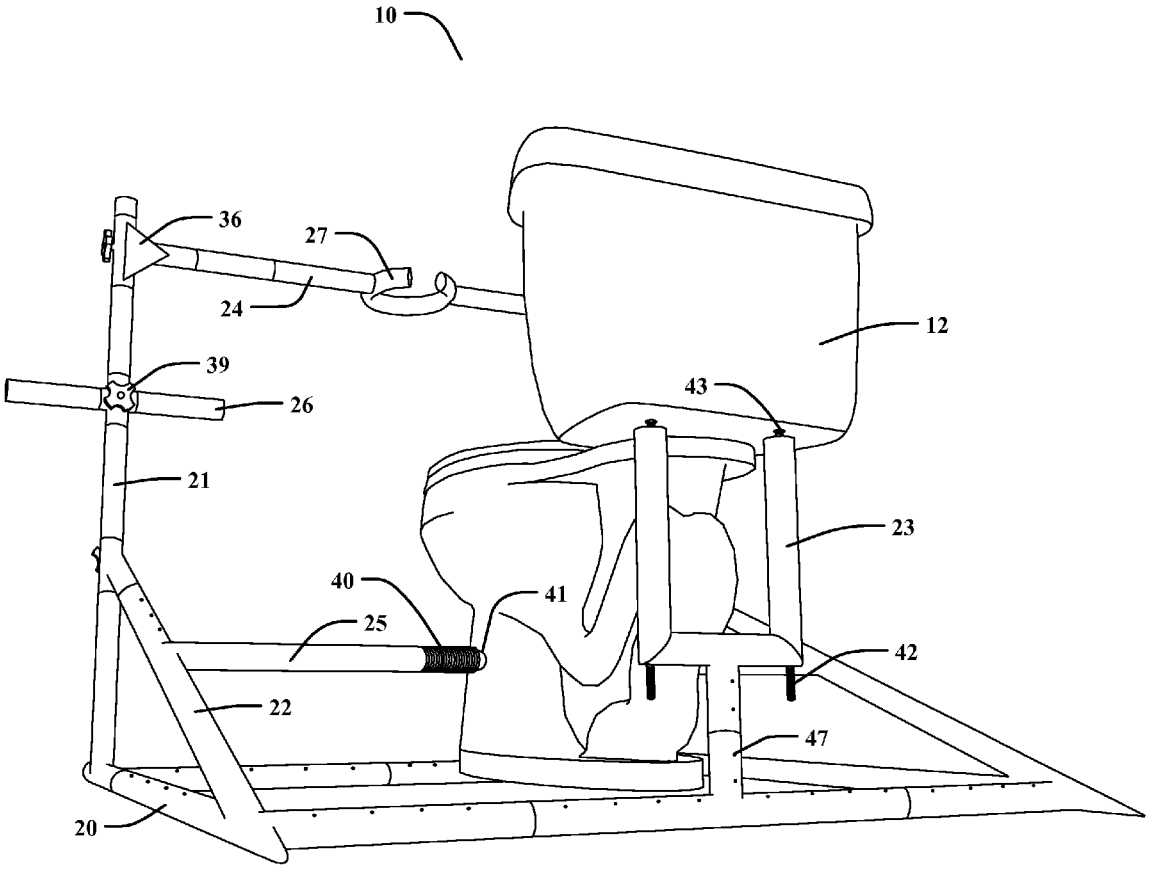
FIG. 5 is a rear isometric view of the invention.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

The restroom aid 10 comprises a lightweight, yet sturdy, fully adjustable tubular frame that, when positioned around a toilet 12, will provide its user a fully adjustable padded rest and support for his or her arms, neck, and head. The frame comprises a lightweight, sturdy, ½-1 inch rounded or squared tubing. Powder-coated aluminum is the preferred material, although rigid plastic, steel, or other suitable material can be used. The invention will rest on the bathroom floor, enclosing the toilet 12 and using the floor and the toilet 12 as leverage to provide support.

The base 20 of the restroom aid 10 comprises four tubular horizontal sections that are connected in a rectangular shape. The four tubular horizontal sections are labeled the front section 31, a rear section 32, a left section 33, and a right section 34. The base 20 will be placed around the toilet 12, and the user will step into the base 20 to use the restroom aid 10. The base 20 will range in size from 24 to 36 inches in width and 24 to 36 inches in depth. While the preferred embodiment comprises a rectangular shape, any shape can be used that will provide support for the entire assembly.

Several boots 35 are attached to the base 20, preventing unwanted movement and while the restroom aid 10 rests on the floor. The boots 35 can be made from any suitable rubber or plastic with a sufficient coefficient of friction to restrict movement. The preferred embodiment comprises four boots 35, one near each edge of the base 20, but any number of boots 35 can be used to provide sufficient strength and rigidity.

Two parallel vertical posts 21 are rotatably attached perpendicular to the base 20, positioning themselves in front of the toilet 12 at the ends of the front section 31. The vertical posts 21 will attach to the base 20 with brackets 36 to allow for the rotation. The vertical posts 21 range from 24 to 60 inches in height. While the preferred embodiment comprises two vertical posts 21, any number can be used.

The vertical posts 21 feature two padded 37, rotatable armrests 26, one on either side, and a pivoting crossbar 24 above the armrests 26. The crossbar 24 attaches to the vertical posts 21 using a bracket 36 on one side and a locking means 52 on the other. The locking means 52 can be a pin-lock. A padded headrest 27 is positioned between the pivoting crossbar 24, offering support for the individual's head and neck while they are seated on the toilet 12. While the preferred embodiment illustrates an oval headrest 27, any shape can be used to sufficiently provide support for the head and neck.

Two diagonal support braces 22 are attached longitudinally to the base 20 and vertical posts 21 to provide additional support. The support braces 22 can also move upward and sliding attachment 38 at a desired location. The support braces 22, having a variable length, provides for a change of angle of the vertical posts 21 when the sliding attachment 38 is adjusted. The angle of the vertical posts 21 to the base 20 can vary from 30° to 135°, and the angles are defined by the stoppers 48 preventing movement past a certain point.

At the midpoint of the support braces 22, two auxiliary braces 25 project inward. The auxiliary braces 25 are threaded 40, providing for adjustable end-caps 41 to move along them. As such, the two auxiliary braces 25 and end-caps 41, one on either side, will press into the sides of the toilet 12 pedestal. The auxiliary braces 25 provide support for side-to-side movement.

A Y-shaped toilet brace 23 rises vertically from the rear section 32 of the base 20. The toilet brace 23 comprises two threaded portions 42, providing for adjustable end-caps 43 to move along them. The toilet brace 23 abuts the rear of the toilet 12, and secures itself with adjustable end-caps 43. The toilet brace 23 and end-caps 43 not only anchor the restroom aid 10 in position, but, along with the base 20 and auxiliary braces 25, provide the resistance and leverage to hold the vertical posts 21 when the user raises or lowers his or her body to the toilet 12.

Figure 6:
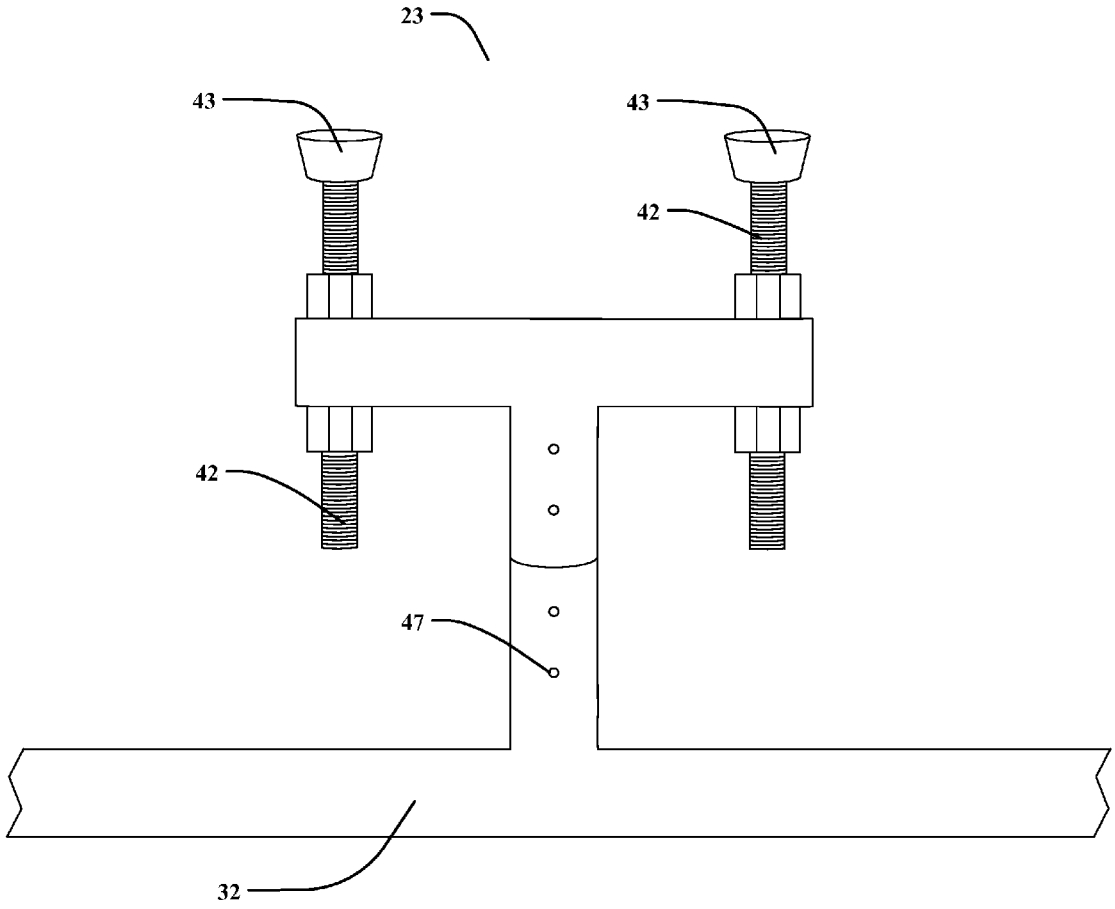
FIG. 6 is a front view of the support brace according to an alternate embodiment of the invention.
Figure 7:
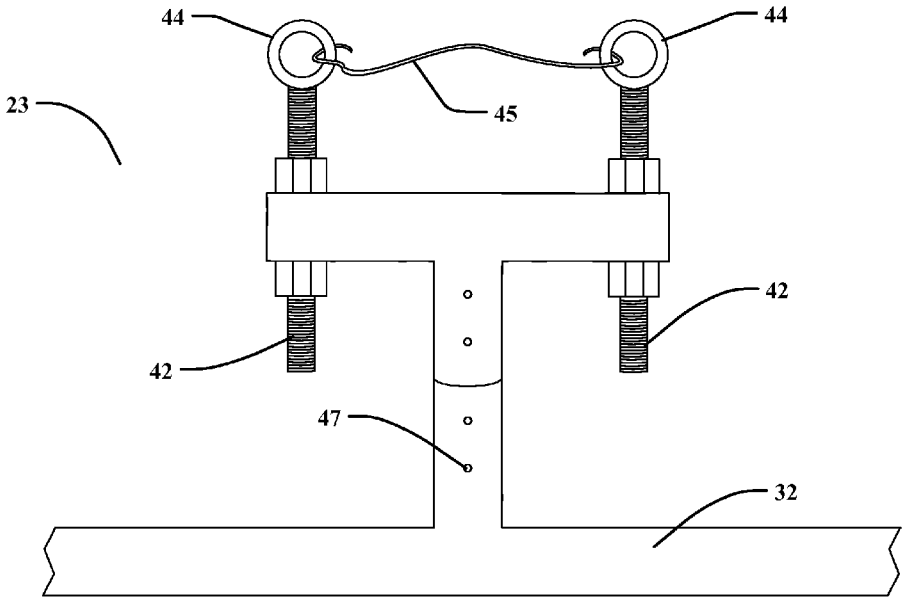
FIG. 7 is a front view of the support brace according to an alternate embodiment of the invention.
Figure 8:
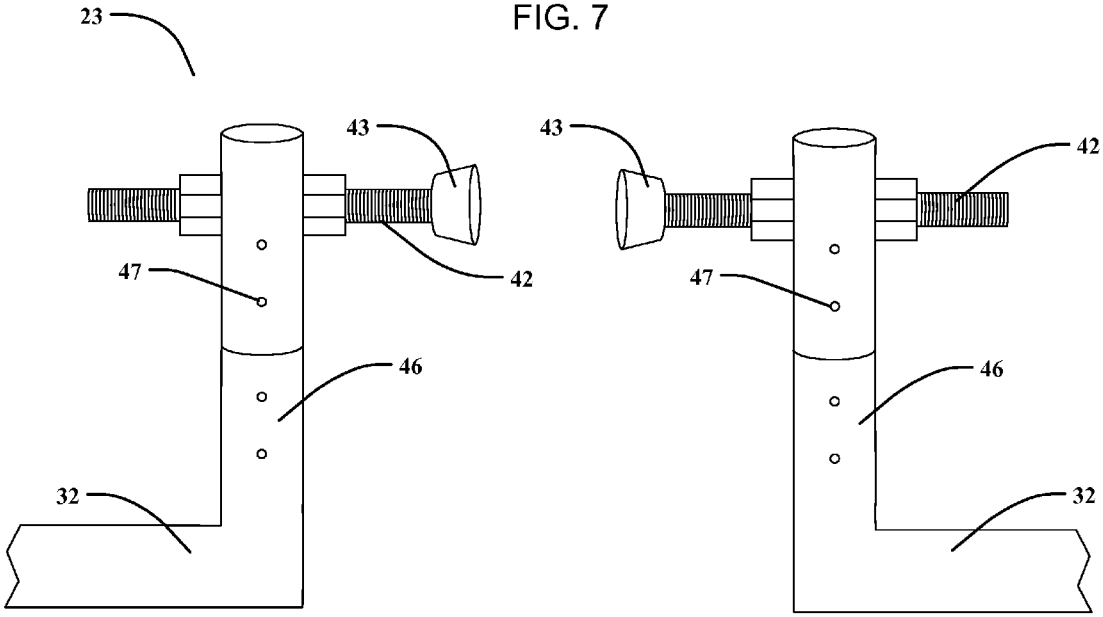
FIG. 8 is a front view of the support brace according to an alternate embodiment of the invention.
Figure 9:
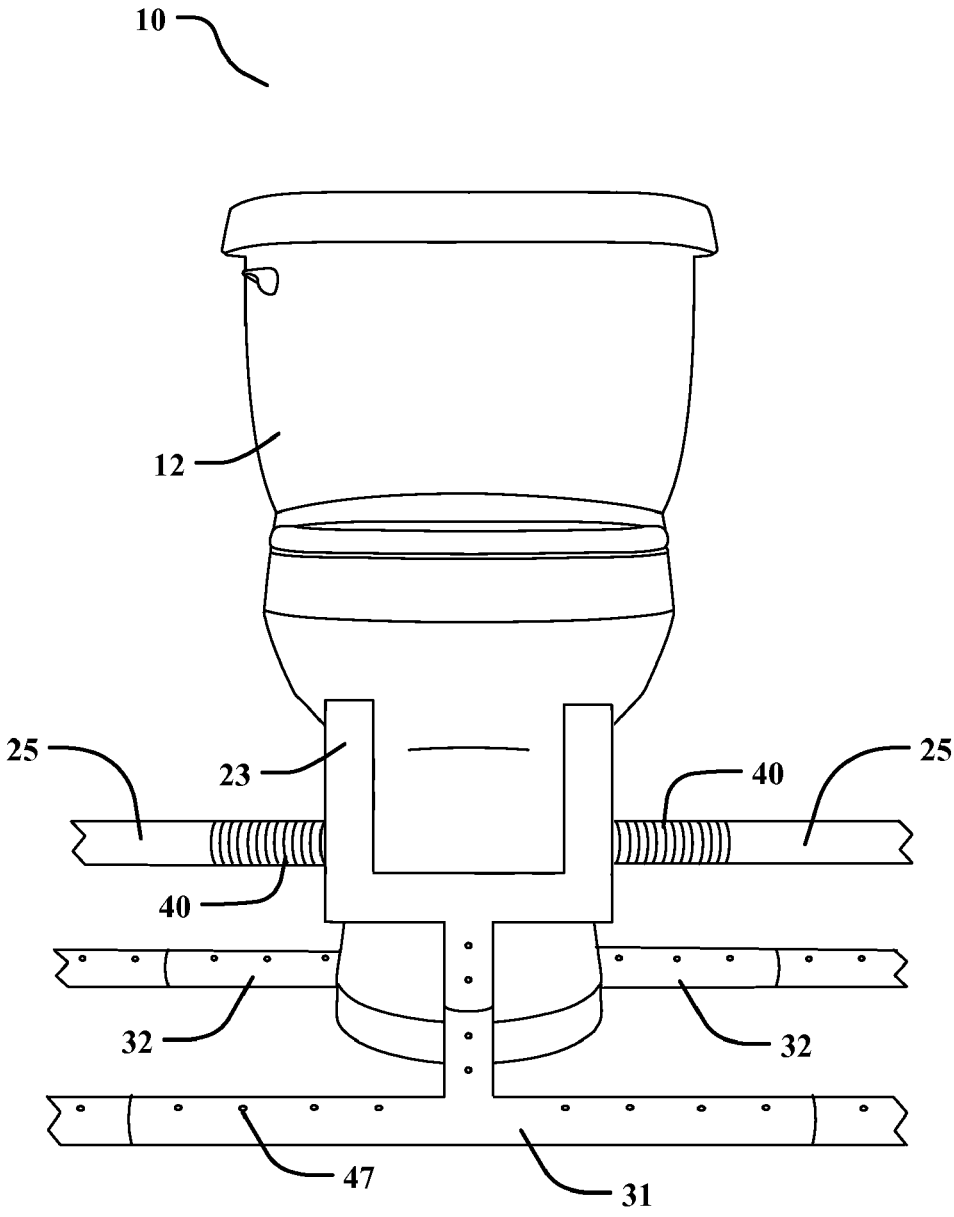
FIG. 9 is a front view of the support brace according to an alternate embodiment of the invention.

In an alternative embodiment, if the toilet 12 provides a reservoir that is very low to the ground, a fully adjustable toilet brace (FIG. 6) can be used, allowing for an increased range for the end-caps 43 to secure themselves to the reservoir of the toilet 12. In a further alternative embodiment, if the toilet 12 does not provide a reservoir, threaded eyelets 44 and a securing means 45 can be used to tie the toilet brace 23 to the toilet 12 (FIG. 7). In an even further alternative embodiment, the toilet brace 23 comprises two risers 46 arising from the rear section 32 of the base 20, each riser 46 providing a horizontal threaded section 42 and end-cap 43 to clamp onto the toilet 12 (FIG. 8) similar to the auxiliary braces 25, the horizontal threaded section 42 and end-cap 43 being replaceable by threaded eyelets 44 and a securing means 45. In still an even further embodiment, there may be a second toilet brace 23, in any of the above varieties, positioned in the center of the front section 31 of the base 20 and securing the toilet 12 from the front as well (FIG. 9).

The restroom aid 10 and fittings, including the base 20, vertical posts 21, support braces 22, toilet brace 23, crossbar 24, and auxiliary braces 25, feature telescoping, tube-within-tube, hole-and-pin mechanisms 47 for easy adjustability and assembly/disassembly. As such, the height, width, and depth of the device may be easily adjusted to accommodate bathrooms and toilets 12 of different sizes, as well as larger and smaller individuals. Furthermore, disassembly of the restroom aid 10 would be a simple matter of removing a few holding pins 47 and separating the tubular components of the frame, without the need of additional tools.

The height of the armrests 26 and crossbar 24 are also fully adjustable by means of sliding-tube attachments 38 and tightening knobs 39. The headrest 27 can be rotated to combination of adjusting the angle of the vertical posts 21 and height of the crossbar 24 provide for a better height, position, and angle of the headrest 27.

The crossbar 24 can also be rotated to an open position 51 from the closed position 50, allowing the user to enter and exit the restroom aid 10 without obstruction. Furthermore, the two armrests 26 are designed to rotate 360 degrees 55 along the vertical axis created by the vertical posts 21, thus presenting the user with a wide variety of positions for supporting his or her arms, forearms, and hands. A knob 39 is used to retain the desired rotational position of the armrests 26 as well as the sliding means 38 to retain the vertical position of the armrests 26. The armrests 26 and headrest 27 will be covered in a firm yet supportive and comfortable foam.

While a particular form of the invention has been illustrated and described, it will be apparent that various modifications can be made without departing from the spirit and scope of the invention. For example, the restroom aid 10 may be adapted to fit other types of restrooms and toilets 12 that have not been mentioned. Furthermore, a method of adjusting the restroom aid 10 may be implemented using a different means, so long as the spirit of the invention has not been lost. Accordingly, it is not intended that the invention be limited, except as by the appended claims.

Particular terminology used when describing certain features or aspects of the invention should not be taken to imply that the terminology is being redefined herein to be that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A restroom aid comprising:

a rectangular base having a front section, a rear section, a left section, and a right section;

a first vertical post having a distal end and a proximal end, whereas the proximal end is hingeably attached to the rectangular base at the intersection of the front section and the left section;

a second vertical post having a distal end and a proximal end, wherein the proximal end is hingeably attached to the rectangular base at the intersection of the front section and the right section;

a first support brace having a distal end and a proximal end, wherein the proximal end is hingeably attached to the base at the intersection of the rear section and left section and the distal end is slideably attached to a midpoint of the first vertical post;

a second support brace having a distal end and a proximal end, wherein the proximal end is hingeably attached to the base at the intersection of the rear section and right section and the distal end is slideably attached to a midpoint of the second vertical post;

a Y-shaped toilet brace having a left distal end, a right distal end, and a proximal end, wherein the proximal end is perpendicularly and securedly attached to the center of the rear section of the base, and wherein the left and right distal ends each have length adjustable end-caps;

a left auxiliary brace having a distal end and a proximal end, wherein the proximal end is inwardly and slideably attached to the center of the left support brace with the distal end having a length adjustable end-cap;

a right auxiliary brace having a distal end and a proximal end, wherein the proximal end is inwardly and slideably attached to the center of the right support brace with the distal end having a length adjustable end-cap;

a crossbar having a distal end and a proximal end, wherein the proximal end is hingeably and slideably attached to the left vertical post and the distal end is lockably and slideably attached to the right vertical post;

a left armrest rotatably and slideably attached to the center of the left vertical post;

a right armrest rotatably and slideably attached to the center of the right vertical post; and a headrest rotatably connected to the center of the crossbar.

2. The restroom aid of claim 1, wherein the distal ends of the left and right support braces are operatively connected to the first and second vertical posts such that slidably raising the support braces along the vertical posts decreases the angle between the vertical posts and the rectangular base, and slidably lowering the support braces along the vertical posts increases the angle between the vertical posts and the rectangular base.

3. The restroom aid of claim 1, wherein the crossbar has a first and second position, the first position defined as having a substantially horizontal position between the left and right vertical posts, and the second position defined as having a substantially vertical position relative to the left post.

4. The restroom aid of claim 1, wherein the base, left vertical post, right vertical post, left support brace, right support brace, toilet brace, crossbar, left auxiliary brace, and right auxiliary brace further comprise a telescoping, tube-within-tube, hole-and-pin mechanism.

5. The restroom aid of claim 1, wherein the base, left vertical post, right vertical post, left support brace, right support brace, toilet brace, crossbar, left auxiliary brace, and right auxiliary brace further comprise a detachable, telescoping, tube-within-tube, hole-and-pin mechanism.

6. The restroom aid of claim 1, wherein the lockable attachment of the crossbar is a pin lock.

7. The restroom aid of claim 1, wherein all slideable attachments further comprise sliding-tube attachments and tightening knobs.

8. The restroom aid of claim 1, wherein the length-adjustable end-caps are operably connected to the distal end of the auxiliary braces such that screwing the end cap about the auxiliary braces adjusts the length of the end cap.

9. The restroom aid of claim 1, wherein the left and right distal ends of the toilet brace each have a threaded section and adjustable eyelets with an attachment means securing the toilet to the eyelets.

10. The restroom aid of claim 1, wherein the toilet brace comprises two vertical risers, each having inward-facing length-adjustable end-caps operably connected to the vertical risers such that screwing the end caps about the vertical risers adjusts the length of the end caps.

* * * * *